United States Patent [19]

Hoffman

[11] Patent Number: 5,046,961

[45] Date of Patent: Sep. 10, 1991

[54] POSITIVE LOCKING ELECTRICAL PLUG

[75] Inventor: Ernest G. Hoffman, Middlefield, Conn.

[73] Assignee: Hubbell Incorporated, Orange, Conn.

[21] Appl. No.: 617,820

[22] Filed: Nov. 26, 1990

[51] Int. Cl.[5] ..... H01R 13/625

[52] U.S. Cl. ..... 439/141; 439/333; 439/337

[58] Field of Search ..... 439/140, 141, 318, 332–337, 439/324

[56] References Cited

U.S. PATENT DOCUMENTS

| | | | |
|---|---|---|---|
| 2,396,901 | 3/1946 | Tiffany | 439/140 |
| 2,423,250 | 7/1947 | Modrey | 439/324 |
| 2,684,860 | 7/1954 | Rafferty | 285/85 |
| 2,750,571 | 6/1956 | Schmier | 439/472 |
| 2,941,178 | 6/1960 | Hubbell et al. | 439/333 |
| 3,120,987 | 2/1964 | Degnan et al. | 439/588 |
| 3,233,204 | 1/1966 | De Vore, Jr. | 439/333 |
| 3,390.404 | 6/1968 | Murchison | 439/589 |
| 3,393,395 | 7/1968 | Hubbell | 439/333 |
| 3,500,291 | 3/1970 | Hubbell et al. | 439/337 |
| 3,739,321 | 6/1973 | Murphy et al. | 439/589 |
| 3,754,205 | 8/1973 | Lenkey | 439/141 |
| 3,790,914 | 2/1974 | Hough | 439/102 |
| 3,888,559 | 6/1975 | Geib | 439/258 |
| 3,890,025 | 6/1975 | Gray | 439/102 |
| 3,950,059 | 4/1976 | Anhalt et al. | 439/261 |
| 4,241,969 | 12/1980 | D'Amato et al. | 439/318 |
| 4,340,267 | 7/1982 | Nukaga | 439/141 |
| 4,354,723 | 10/1982 | Lee | 439/462 |
| 4,445,739 | 5/1984 | Wooten | 439/140 |
| 4,820,176 | 4/1989 | Niikura | 439/152 |

FOREIGN PATENT DOCUMENTS

| | | |
|---|---|---|
| 486174 | 11/1953 | Italy . |
| 500653 | 2/1939 | United Kingdom . |

*Primary Examiner*—Neil Abrams

*Attorney, Agent, or Firm*—Jerry M. Presson; Alfred N. Goodman

[57] ABSTRACT

A male electrical connector with positive locking prongs and shielded blade protection. The connector comprises a plug body, a plurality of curved blades extending therefrom, a cover rotatably coupled to the plug body, and a shield carrying locking prongs and axially slidably coupled to the blades and plug body. The cover carries a set of cams and the shield carries a set of cam followers, rotation of the cover relative to the shield camming the shield and its locking prongs axially towards the plug body and out of locking engagement with slots in a female receptacle. In a first embodiment, the cover encloses a cable clamping assembly, while in a second embodiment the clamping assembly is outside the cover.

24 Claims, 3 Drawing Sheets

FIG. 5
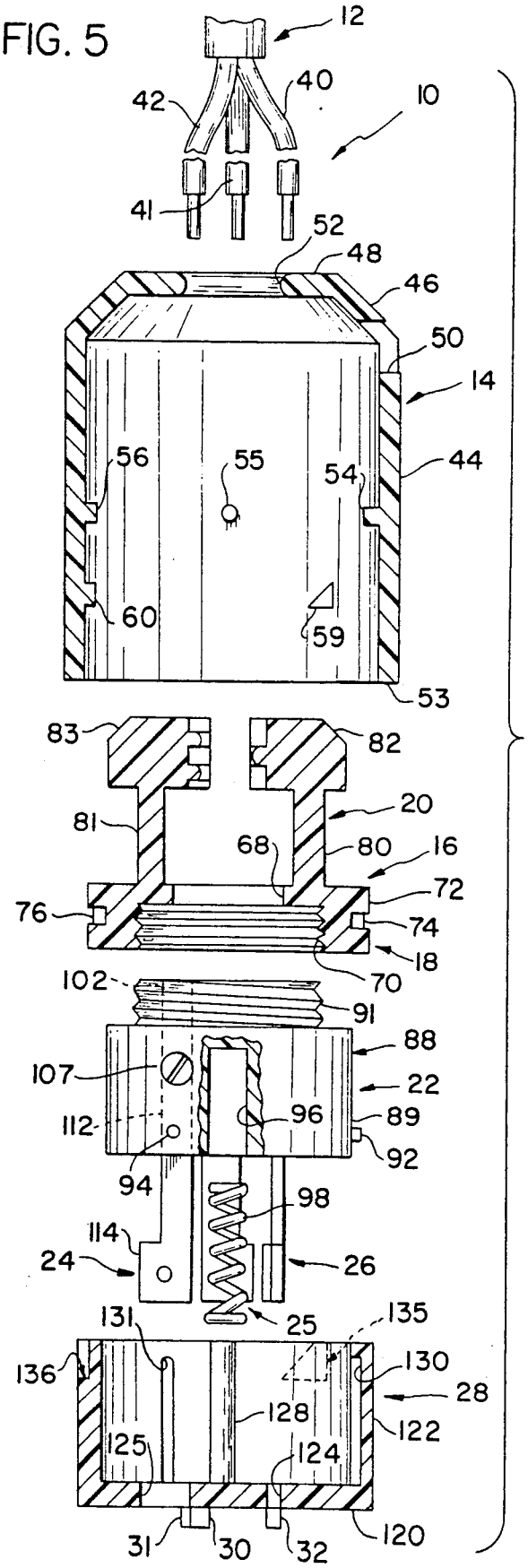
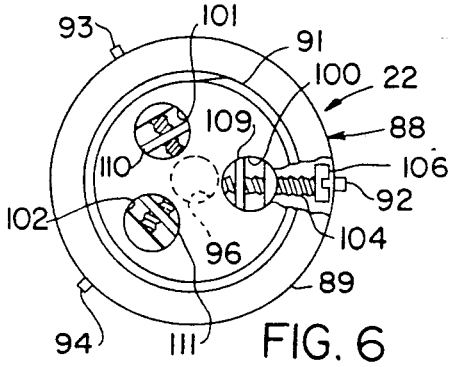
FIG. 6
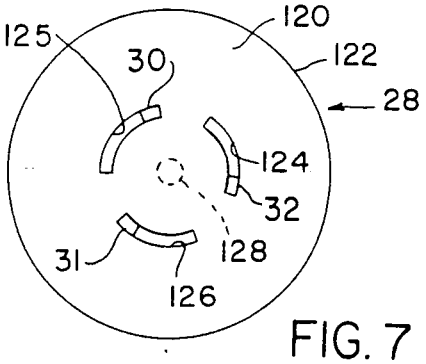
FIG. 7
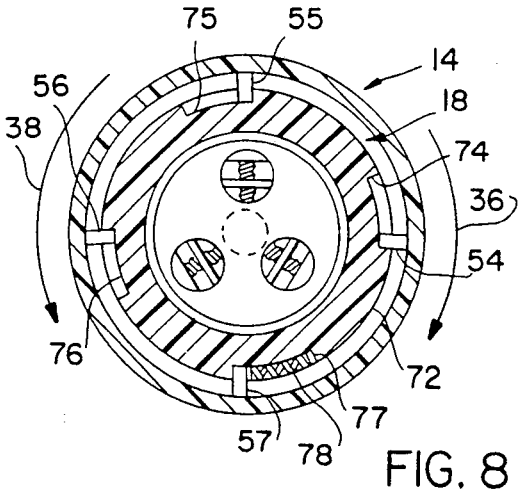
FIG. 8

POSITIVE LOCKING ELECTRICAL PLUG

FIELD OF THE INVENTION

The invention relates to electrical connectors, and more particularly to male electrical connectors having a plurality of blades and a mechanism for positively locking the male connector to a female receptacle to avoid inadvertent disconnection therebetween. The connector is unlocked by angularly translating the connector's cover, and includes a slidable shield for the blades.

BACKGROUND OF THE INVENTION

Electrical connector assemblies of the locking type are well-known in the connector industry. Normally, the female portion of such a connector assembly has two or more arcuate, circularly arranged slots, and the male portion has an equal number of arcuate blades, the blades being dimensioned and arranged so that they can be inserted in the slots by a simple axial movement, and then, via rotation of one or both of the connector portions, the blades can be moved into a position from which they cannot be separated by simple axial movement. To accomplish this, one or more of the blades usually has an L-shaped configuration in which the laterally extending portion, or flag, of the blade engages a recess or shelf within the slot as a result of the rotation.

The male and female portions can take various configurations, but the male portion is usually a plug connected to the end of a multi-conductor cable. The female portion may also terminate a similar cable, or it can be a fixture or receptacle mounted in a partition or on a piece of equipment. In any event, it is possible for the cable attached to the male portion to be subjected to various forces which might tend to rotate the cable and also the male connector portion in the unlocking direction, thereby causing inadvertent unlocking and extraction of the blades from the slots.

To prevent this kind of undesired extraction, there has been an effort to develop connectors which have greater resistance to accidental disconnection or which have locking devices capable of precluding such accidental disconnection. However, many of these prior art devices are complicated to manufacture, assemble and use, and many of them require a significant number of parts and a specially designed female device to cooperate with the male device.

In addition, many of these electrical connector assemblies have some sort of shield which temporarily covers the blades during shipping or handling to protect the blades against distortion. However, once again, many of these devices are unduly complicated to manufacture, assemble and use, and require numerous parts.

Examples of various locking connectors are disclosed in the following U.S. Pat. Nos.: 2,684,860 to Rafferty; 2,750,571 to Schmier; 3,120,987 to Degnan et al.; 3,390,404 to Murchison; 3,393,395 to Hubbell; 3,500,291 to Hubbell et al; 3,739,321 to Murphy et al; 3,790,914 to Hough; 3,888,559 to Geib; 3,890,025 to Gray; 3,950,059 to Anhalt et al; and 4,241,969 to D'Amato et al. Similar devices are disclosed in Italian patent 486174 and U.K. patent 500653.

In addition, examples of prior devices providing shields for the blades of electrical connectors are disclosed in the following U.S. Pat. Nos.: 2,396,901 to Tiffany; 2,423,250 to Modrey; 3,754,205 to Lenney; 4,340,267 to Nukaga; 4,445,739 to Wooten; and 4,820,176 to Niikura.

SUMMARY OF THE INVENTION

Accordingly, a primary object of the invention is to provide a male electrical connector with a rotatably released positive locking feature.

Another object of the invention is to provide a male electrical connector that is relatively simple to manufacture, assemble and use, and that has a relatively few number of parts.

Another object of the invention is to provide a male electrical connector that can be provided with a shield for the blades.

A further object of the invention is to provide a male electrical connector with a shield biased away from the cable which ejects the connector from the female device under conditions of inadequate blade engagement.

The foregoing objects are basically attained by providing a tubular cover having a first open end adapted to receive an electrical cable, and a second open end; an insulating plug body adapted to receive the electrical cable, and having a plurality of conductive blades extending therefrom, the blades being shaped and dimensioned for insertion into and translation in slots formed in a mating female connector as the plug body is moved axially and angularly, respectively, relative to the female connector; a first mechanism, coupled to the cover and plug body, for coupling the plug body in the cover for limited relative angular movement; a plate having a plurality of openings, each of the openings slidably receiving one of the blades therein; a second mechanism, coupled to the plate and plug body, for slidably coupling the plate and plug body between first and second axially displaced positions; a locking assembly, coupled to and extending from the plate and receivable in at least one of the slots in the female connector once the blades are inserted into and translated in a first angular direction in the slots, for resisting relative angular translation of the plate and the female connector in a second angular direction opposite the first angular direction; and an unlocking assembly, coupled to the cover and plate, for removing the locking assembly from the at least one of the slots, and thereby allowing relative angular translation of the plate and the female connector in the second angular direction, the unlocking assembly being actuated via angular movement of the cover relative to the plate and plug body in the second angular direction.

Other objects, advantages and salient features of the invention will become apparent from the following detailed description, which, taken in conjunction with the annexed drawings, discloses preferred embodiments of the invention.

DRAWINGS

Referring now to the drawings which form a part of this original disclosure:

Figure 1:
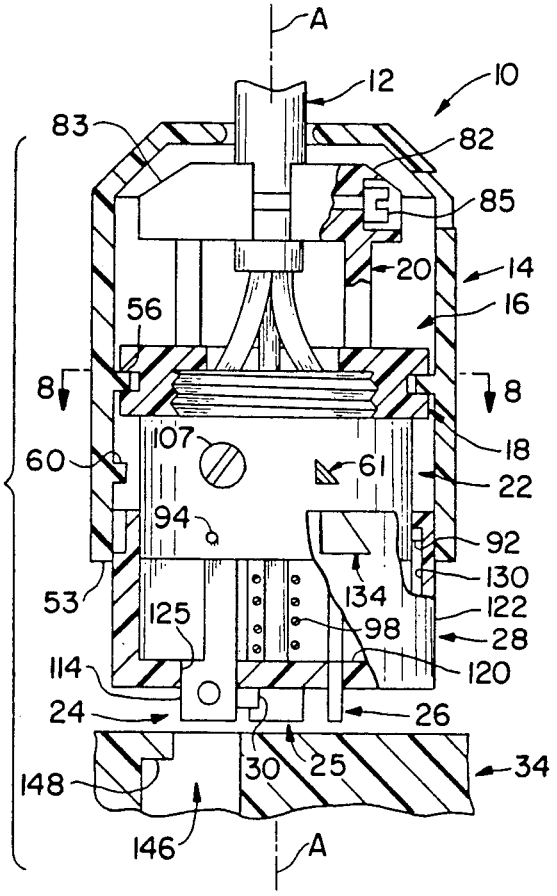
FIG. 1 is a side elevational view in substantially longitudinal section of the male electrical connector in accordance with the present invention in its first or rest position and with a portion of the mating female receptacle being shown in longitudinal section.
Figure 2:
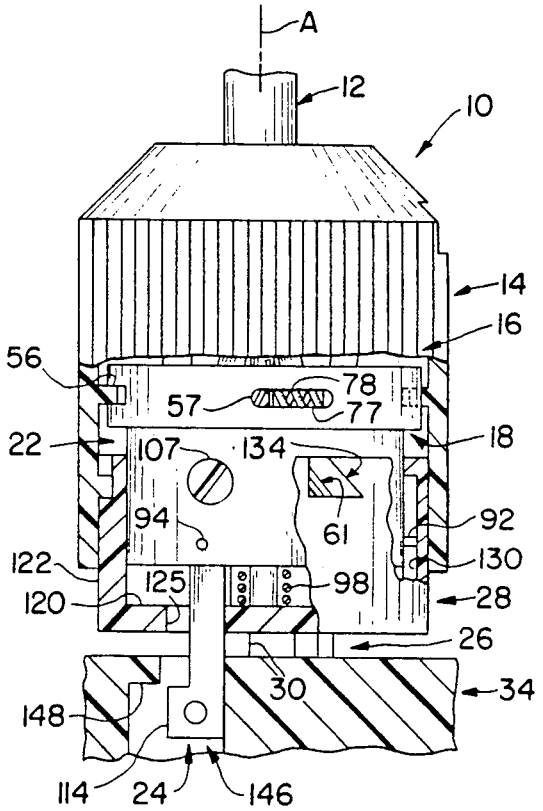
FIG. 2 is a side elevational view of the male electrical connector and female receptacle as shown in FIG. 1 with parts broken away, the shield on the male connector having a locking prong engaging the receptacle, the shield being in its second position extended upwardly into the cover, and one of the blades being received in a slot in the female receptacle.
Figure 3:
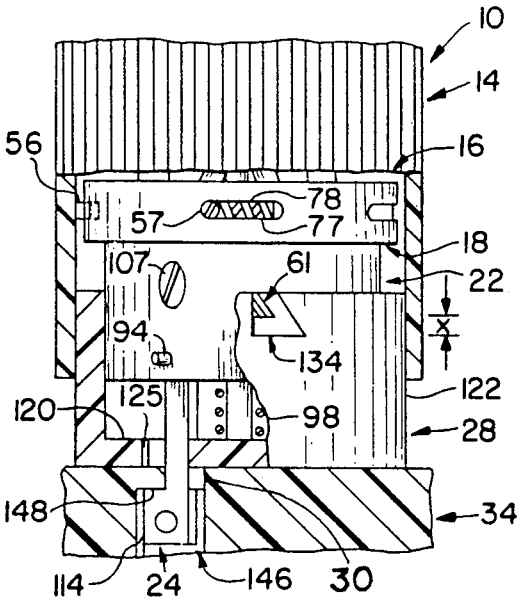
Figure 4:
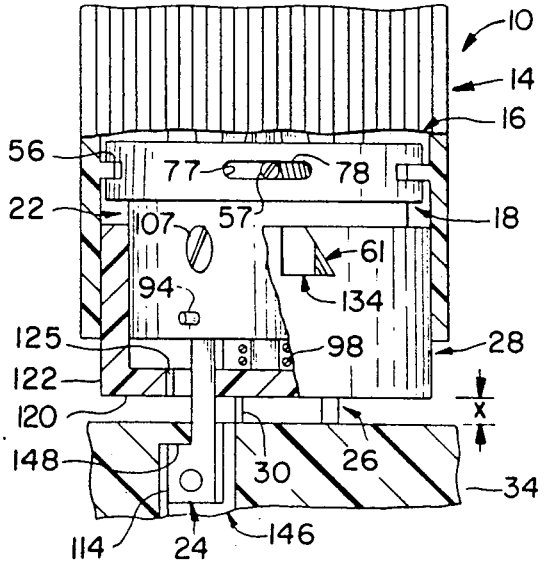
Figure 9:
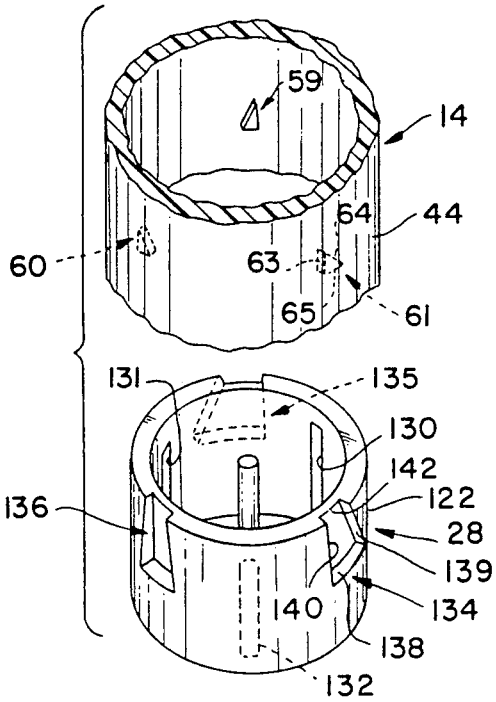
Figure 10:
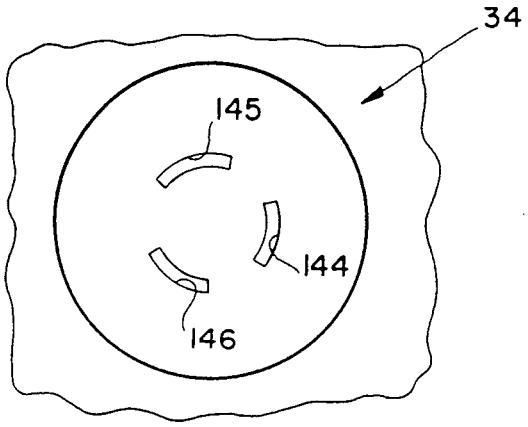
Figure 11:
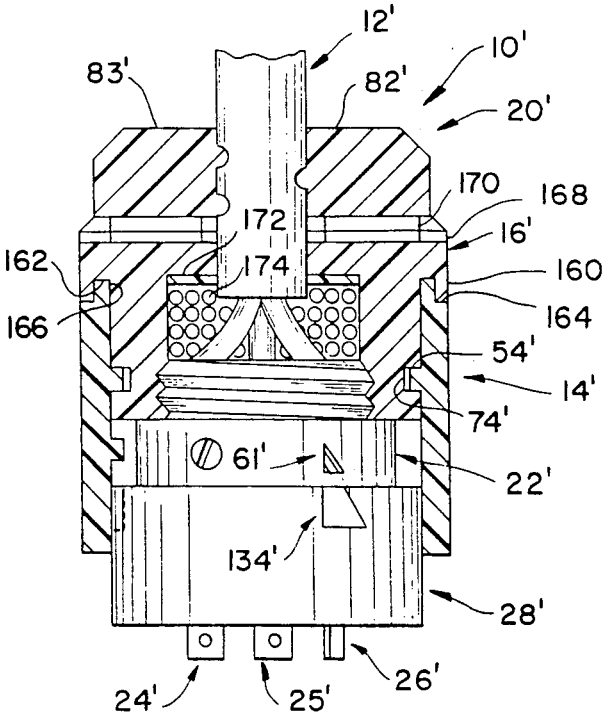

FIG. 3 is a side elevational view of the male connector and female receptacle as shown in FIG. 2, except that the male connector has been rotated in a first angular direction, clockwise as viewed from above, the blade has translated in the slot beneath the shelf therein, and the locking prong has moved downwardly into the slot in the female receptacle, thereby locking the male connector to the female receptacle;

FIG. 4 is a side elevational view of the male connector and female receptacle as seen in FIG. 3, except that the cover of the male connector has been rotated in a second unlocking angular direction, counterclockwise when viewed from above, the shield has been biased upwardly via cams on the cover and cam followers on the shield and the locking prong has been moved upwardly out of the slot in the female receptacle, continued angular movement of the male connector allowing the blade to be free from the shelf in the slot and then removed by an upward axial movement of the connector relative to the female receptacle;

FIG. 5 is an exploded side elevational view of the male connector shown in FIGS. 1-4 in substantial longitudinal section;

FIG. 6 is a top plan view in partial section of the blade retainer shown in FIGS. 1-5;

FIG. 7 is a bottom plan view of the shield shown in FIGS. 1-5 showing the slots in the shield and the three locking prongs thereon;

FIG. 8 is a reduced top plan view in transverse section of the cover and the plug body actuating ring taken along line 8—8 in FIG. 1;

FIG. 9 is an exploded, reduced front perspective view of a portion of the cover showing the three cams thereon and the shield showing the three cam follower slots therein;

FIG. 10 is a top plan view of the female receptacle shown in FIGS. 1-4 illustrating the three slots therein; and FIG. 11 is a side elevational view of a modified male electrical connector in accordance with the invention in which the clamping members are outside the cover and the cover itself is merely a tubular sleeve.

DETAILED DESCRIPTION OF THE INVENTION

As seen in FIGS. 1-10, the male electrical connector 10 in accordance with the invention comprises an electrical cable 12; a cover 14; a plug body 16 including an actuating ring 18, a clamping assembly 20, and a blade retainer 22 having blades 24-26 thereon; and a shield 28 having three locking prongs 30-32 extending downwardly therefrom. The cover is rotatably coupled to the plug body, and the shield is slidably coupled to the plug body in the axial direction.

The male electrical connector 10 is connected to the female receptacle 34 by inserting the blades in the receptacle and angularly translating the blades therein. This first angular locking direction is indicated in FIG. 8 via arrow 36 which is clockwise around longitudinal axis A of connector 10 when viewed from the cable end of the connector. To unlock the connector and receptacle, the cover is angularly rotated in a second unlocking direction, opposite from the first direction, indicated by arrow 38 in FIG. 8, this direction being counterclockwise when viewed from the cable end of the connector.

Cable 12 preferably has a plurality of conductors and preferably three insulated conductors 40-42 as seen in FIG. 5 with exposed ends for electrical connection with the blades.

Cover 14 comprises a tubular and preferably cylindrical sidewall 44, a frustoconical wall 46 extending upwardly from the top of the sidewall, and a planar disc-shaped end wall 48 closing the top of the frustoconical wall 46. Preferably, all three walls are integrally formed of a non-conducting plastic material which is somewhat flexible. At the intersection of the side and frustoconical walls is an opening 50 for access to the clamping assembly 22 via a screwdriver. End wall 48 has a central opening 52 which forms a first open end in the cover and receives the electrical cable 12 therethrough with sufficient clearance to allow for relative angular movement of the cover relative to the cable. The cover has a second open end 53 at its opposite end.

Four substantially cylindrical projections 54-57, as seen in FIGS. 1-5 and 8, are formed on the inside surface of sidewall 44 in the cover and are preferably integrally formed with the cover, although they could be attached by any suitable fasteners. The four projections extend radially inwardly of the sidewall, are spaced substantially equally by 90° in the circumferential direction, and are located in substantially the same plane, which is perpendicular to the axis A of the connector. These projections are rigidly coupled to the cover and support the cover for angular movement relative to the plug body 16.

In addition to the projections, three triangular cams 59-61, as seen in FIGS. 1-5 and 9, extend radially inwardly from the inner surface of sidewall 44 in the cover 14. These cams are also aligned in substantially the same plane perpendicular to the longitudinal axis A of the connector and are spaced below projections 54-57. These cams are substantially equally spaced in the circumferential direction by about 120°.

Each cam is substantially the same in construction and configuration, and thus, the details of only cam 61 will be described, although they do apply to the other two cams 59 and 60.

Thus, as seen in FIG. 9, cam 61 has three planar surfaces comprising first surface 63, second surface 64, and third surface 65. First surface 63 faces in the first angular direction and is parallel to the longitudinal axis A of the connector. Second surface 64 faces the second angular direction and tapers upwardly and towards first surface 63 at an angle of about 45°. The third surface 65 faces downwardly toward the bottom of the shield 28 and is substantially perpendicular to the longitudinal axis A of the connector. First surface 63 is substantially perpendicular to third surface 65, and second surface 64 extends at an angle of substantially 45° to the first and third surfaces.

The plug body 16 comprises the actuating ring 18, the clamping assembly 20, the blade retainer 22, and the three blades 24-26.

Actuating ring 18 is preferably formed of plastic, is annular and has an outside diameter slightly smaller than the diameter of the inner surface of wall 44 in the cover to allow for relative angular translation therebetween. Actuating ring 18 has a central through opening 68 for the reception of the conductors 40-42 in cable 12 therethrough, and the opening includes a lower internal threaded portion 70 having a larger diameter than opening 68 for threaded connection with the blade retainer 22. Formed in the outer wall 72 of actuating ring 18 are four horizontally oriented slots 74–77, which are substantially equally spaced by 90° in the circumferential direction, extend about 30° in that direction, and slidably receive respectively one of the projections 54–57 in the cover as illustrated best in FIG. 8. Slot 77 receives a compression spring 78 therein, which engages the right-hand side of slot 77 at one end, and at the other end engages projection 57 to normally bias projection 57 and cover 14 in the first angular direction 36 relative to the actuating ring 18. Thus, if cover 14 is moved in the second angular direction 38, it will be biased in the opposite direction. As seen in FIG. 8, the normal or rest position of the projections 54–57 is substantially up against the left-hand end of the slots 74–77, which form a stop for the relative angular movement of the cover and the actuating ring in the first angular direction. Spring 78, in its compressed state, would form a stop for the cover and actuating ring in the opposite angular direction, but would allow a lost motion between the cover and actuating ring having an angular extent substantially equal to the difference in axial length of the compressed spring 78 and its rest condition as shown in FIG. 8.

The clamping assembly 20 comprises two flexible support rods 80 and 81 extending upwardly and integrally from the actuating ring and having respectively first and second clamping members 82 and 83 integrally formed at the tops thereof. The clamping members 82 and 83 receive the electrical cable 12 therethrough as seen in FIG. 1, and tightly grip the cable therebetween by means of two screws threadedly coupled thereto, only screw 85 being shown in FIG. 1.

Blade retainer 22 comprises a plastic main body 88 having a substantially cylindrical outer surface 89 with a diameter smaller than the diameter of the sidewall 44 of the cover, and has a reduced diameter threaded portion 91 at the top thereof for threaded engagement with threaded portion 70 in the actuating ring 18.

Extending preferably integrally and radially outwardly from outer surface 89 are three substantially equally spaced pins 92–94, which are spaced apart in the circumferential direction by about 120°. These pins slidably couple the shield 28 to the blade retainer, as will be described in more detail hereinafter, and have a radial extent spaced from the side wall 44 of the cover.

Extending axially upwardly from the bottom of main body 88 is a central blind bore 96, which receives a portion of a compression spring 98 therein for biasing the shield 28 axially away from the blade retainer 22.

As seen in FIGS. 5 and 6, three axial bores 100–102 are formed in the blade retainer 22 spaced in the circumferential direction by about 120° and extending downwardly from the top of the threaded portion 91. Each of these axial bores is intersected by a transverse radially directed bore, only bore 104 being shown in FIG. 6, each of these bores receiving a screw, only screws 106 and 107 being shown in FIGS. 1–5 and 6. Located in each of the axial bores 100–102 are, respectively, plates 109–111, each of these plates having a suitable threaded bore for threadedly engaging one of the screws, such as screws 106 and 107 therein. As seen in FIG. 5, extending upwardly from the bottom of blade retainer 22 are three axial curved slots, only slot 112 being shown. These slots intersect respectively with one of the axial bores and one of the radial bores in the blade retainer, and each receives respectively one of the blades 24–26 therein. The end of each blade extends upwardly into each axial bore, and has a suitable bore for receiving one of the screws 106 or 107 therein. Each of the axial bores 100–102 receives one of the exposed ends of the conductors 40–42 therein, which are electrically connected to one of the blades via clamping between one of the plates 109–111 and the blade.

As seen best in FIGS. 1–5, each of the metallic blades 24–26 is slightly curved around its longitudinal axis, and has an enlarged flange or flag 114 at the bottom thereof, forming the blade in a substantially L-shaped elevational configuration.

Shield 28 is preferably made of plastic, and has a substantially disc-shaped planar plate 120 forming the bottom wall thereof and a tubular, preferably cylindrical, sidewall 122 extending upwardly from the plate. The longitudinal axis of sidewall 122 is preferably coincident with the longitudinal axis A of the connector, and plate 120 is substantially perpendicular to that axis. Shield 28 is slidably received in the cover through second end 53.

Three curved slots 124–126 are formed in and extend through plate 120 as seen in FIGS. 5 and 7. Slots 124–126 are equally spaced in the circumferential direction by about 120°, and each slot has one of the locking prongs 30–32 adjacent its trailing edge. The circumferential extent of each slot is large enough to slidably receive therein the flag of each blade, and as seen in FIGS. 1–4, each slot slidably receiving a blade therein, preferably with the trailing edge of each blade slidably engaging or being closely adjacent to the trailing edge of each slot.

As seen in FIGS. 5 and 7, each of the locking prongs 30–32 is slightly curved about the longitudinal axis of the connector, and has planar leading and trailing edges which are substantially parallel to each other and to the longitudinal axis A of the connector. The axial extent of each prong as seen in FIG. 4 is designated by a dimension "x".

Extending upwardly and integrally from plate 120 is a central rod 128 which extends substantially to the top of sidewall 122, and is received in compression spring 98, which is in turn received in the blade retainer.

On the inside of the sidewall 122, as seen in FIGS. 5 and 9, are three equally circumferentially spaced blind slots 130–132, which are spaced about 120° apart and extend axially from plate 120 to a position slightly spaced from the top of sidewall 122. Each of these blind slots 130–132 slidably receives one of the pins 92–94 in the blade retainer to slidably, but not rotatably, couple the shield to the blade retainer. The shield is made of somewhat flexible plastic, and thus, the pins can be snapped into the slots and retained therein. Spring 98, as indicated in FIGS. 1–4, biases the shield away from the blade retainer into its first or rest position shown in FIG. 1 in which the pins are at the top of the blind slots, but the shield can be pushed axially upwardly toward the plug body into a fully retracted or second position shown in FIG. 2 in which cams 59–61 halt further retraction.

As seen in FIGS. 1–5 and 9, on the outer surface of sidewall 122 are three cam followers 134–136, each having a substantially right trapezoidal shape in elevation, and formed as an upwardly opening blind slot on the outside of sidewall 122. The outer surface of sidewall 122 slidably engages the inner surface of wall 44 in the cover 14 as indicated in FIGS. 1–4, and likewise the three cams 59–61 on the inside of the cover are slidably received respectively in the cam followers 134–136 in the shield.

Each of the cam followers 134–136 is substantially the same, and therefore, only cam follower 134 as seen in FIG. 9 will be described in detail, the other two cam followers having the same configuration, surfaces and orientation.

Thus, cam follower 134 has three planar surfaces comprising first surface 138, second surface 139 and third surface 140. First surface 138 is substantially perpendicular to the axis A of the connector and faces away from plate 120 at the bottom of the shield. The second surface 139 faces towards the first angular direction and tapers upwardly and towards the third surface 140 at an angle of about 45° to the first surface 138 and the axis A. This second surface, as seen in FIG. 3, has at least an axial extent shown by the dimension "x" which is equal or greater than the axial extent of the locking prongs 30–32 which are also shown to have an axial extent of dimension "x". The third surface 140 faces the second angular direction and is substantially parallel to the longitudinal axis A of the connector, perpendicular to first surface 138, and defines at its upper end and the upper end of the second surface 139 an opening 142, through which cam 61 can enter and leave the interior of cam follower 134 as shown in FIGS. 1–4.

As seen in FIGS. 1–4 and 10, the female receptacle or connector 34 has three slots 144–146 formed therein which are slightly curved to receive the blades therein and are spaced substantially 120° apart in the circumferential direction. Each of the curved slots 144–146 has a downwardly facing shelf, such as shelf 148 in slot 146 shown in FIGS. 1–4. The portion of each slot adjacent the shelf is large enough to axially receive the flag on each blade therein; however, when the blade is fully inserted into the slot and then angularly translated in the first angular direction, the flag 114 on each blade will be received under each shelf, thereby locking each blade in the slot and preventing axial removal thereof as indicated in FIG. 3.

ASSEMBLY AND OPERATION

In assembling the male connector 10 in accordance with the invention, preferably the shield 28 is slidably coupled to the blade retainer 22 with spring 98 being received in bore 96 in the blade retainer and over central rod 128. To accomplish this, the blades 24–26 are slidably received in slots 124–126 in the plate 120 in the shield, and pins 92–94 are snapped into blind slots 130–132 in the shield. In this coupled configuration, spring 98 normally biases shield 28 away from the blade retainer 22 so that plate 120 is spaced from the blade retainer and the flags on the blades extend slightly past plate 120 as seen in FIG. 1.

Advantageously, the actuating ring 18 and clamping assembly 20 coupled thereto are then snap-fitted inside cover 14 by sliding the actuating ring and clamping assembly upwardly into the cover through its second or open bottom end 53 until projections 54–57 are snapped into slots 74–77 in the actuating ring. The cover 44 is sufficiently flexible to allow for this snap-in connection. At this time, compression spring 78 is maneuvered into slot 77 as seen in FIG. 2, biasing projection 57 to the left as seen in FIG. 2 against the end of the slot 77.

Next, cable 12 is maneuvered through opening 52 in cover 14, between clamping members 82 and 83, through opening 68 in the actuating ring, and then the exposed ends of conductors 40–42 are received in axial bores 100–102 in the blade retainer and are electrically connected via screws, such as screws 106 and 107, to the respective blades 24–26.

At this time, the coupled blade retainer 22 and shield 28 are moved axially upwardly into the cover, and the threaded portion 91 on the blade retainer is threadedly engaged with the threaded portion 70 on the actuating ring. This threaded coupling is arranged so that, upon full tightening thereof, each of the cams 59–61 on the cover is axially aligned with one of the cam followers 134–136 on the outside of the shield 28 as illustrated in FIGS. 1–4 and 9. If necessary or desired, the bottom surface of the actuating ring 18 and the top surface of the main body 88 on the blade retainer can have opposed and ultimately interlocking helical ramps to assure that the cams and cam followers are correctly aligned, these helical ramps having radially opposed axial stops to engage one another upon threaded connection and orientation in the correct angular position. In addition, in this aligned position, an upwardly extending tang can be supported by the blade retainer and received in a suitable downwardly facing slot in the actuating ring to prevent unwanted relative angular movement of the actuating ring and blade retainer.

Once the blade retainer and shield are coupled to the actuating ring in the proper alignment, a tool such as a screwdriver can be moved through opening 50 in cover 44 to tighten screws 85 on the clamping assembly to tightly clamp the electrical cable 12 to the clamping members and actuating ring to prevent unwanted removal thereof.

In operation, the male electrical connector 10 is first positioned so that the blades 24–26 align axially with the slots 144–146 in the female receptacle 34 as seen in FIG. 1. Then, the electrical connector 10 is moved axially towards the receptacle with the blades being axially inserted and received in the slots to a position in which the top of the flag 114 on each blade is slightly below the shelf 148 in each slot. This is seen in FIG. 2. In this position, each of the locking prongs 30–32 engages the top of female receptacle 34, and the shield 28 has moved axially upwardly towards the plug body 16 comprised of the actuating ring and blade retainer. This upward movement is stopped when the bottom of each cam 59–61, that is, each of the third surfaces 65 thereon, engages the bottom of each of the cam followers 134–136, that is, the first surfaces 138 thereon. This is likewise shown in FIG. 2.

Then, the cover 14 is rotated, that is, angularly translated, in the first locking angular direction, indicated by arrow 36 in FIG. 8, and this angular translation moves the actuating ring 18, the blade retainer 22, the blades 24–26 and the shield 28 in the same angular direction so that the flag 114 on the bottom of each blade is now received below the shelf in each slot, as seen in FIG. 3. Rotation of cover 14 moves actuating ring 18 therewith since projections 54–57 abut against the left-hand sides of the slots 74–78 therein as seen in FIG. 8. The blade retainer 22 also moves with the actuating ring, since it is threaded thereto, but in addition, the blade retainer moves angularly since it is pinned to the shield 28 via pins 92–94, and cams 59–61 on the cover are in an abutting position in the cam followers 134–136 as seen in FIGS. 2 and 3. In this position, the first surface 63 of each cam abuts the third surface 140 of each cam follower.

Once the flag on each blade is below the shelf in each slot, the trailing edge of each blade is spaced from the trailing edge of each slot in the female receptacle as seen in FIG. 3, and thus each of the locking prongs 30–32 can move downwardly into that space in the slot as seen in FIG. 3. This movement is created via compression spring 98, and is allowed since the shield 28 is slidably coupled to the blade retainer and is slidably received in the cover. In addition, this movement is allowed since the first surface 63 of each cam 59–61 is in a slidable engagement with the third surfaces 140 on each of the cam followers 134–137 as seen by comparing FIGS. 2 and 3.

This relative sliding motion of the shield and the cover and the cams and cam followers is continued until the plate 120 on the shield fully abuts the upper surface of the female receptacle 34, and each of the locking prongs is fully received in each of the slots in the receptacle as seen in FIG. 3.

In this regard, it is important to note that, as seen in FIG. 3, cam 61 is still received in cam follower 134, but has to have its bottom or third surface 65 spaced above the bottom or first surface 138 of the cam follower by at least a distance "x" so that the locking prongs can ultimately be released from the slots in the female receptacle, the axial extent of each locking prong being equal to or less than "x".

In this position shown in FIG. 3, male electrical connector 10 cannot be axially removed from the female receptacle 34 due to the engagement of the flags 114 on each blade engaging the shelf 148 in each slot. In addition, angular translation of the male connector relative to the female receptacle is resisted in the first angular direction by engagement of the main portion of the blade with the leading edge of the slot above the shelf, and angular translation in the second opposite direction is resisted by reception of the locking prongs in the slot. Since the leading and trailing edges of each locking prong are substantially planar and parallel to the longitudinal axis A of the connector, attempted angular translation of the connector relative to the receptacle will be resisted by engagement of the locking prong with the trailing edge of the slot.

To unlock the connector 10 from female receptacle 34, the cover 14 is angularly translated in the second angular direction indicated by arrow 38 in FIG. 8. This angular translation begins in the position shown in FIG. 3, and as the cover 14 is angularly translated, projection 57 in the cover begins to compress spring 78 on the actuating ring. During this movement, cam 61 moves, in a short lost-motion translation, towards the second surface 139 in the cam follower 134, then engages that surface, and then with continued angular movement of the cover, biases the shield 28 upwardly due to the engaging and sliding surface 64 of the cam 61 and surface 139 of the cam follower 134 as seen in FIG. 4. This relative angular translation of the cover 14 is limited by full compression of spring 78 in slot 77. Since the shield 28 has moved vertically upwardly and axially towards the actuating ring, locking prongs 30–32 move upwardly out of the slots in the female receptacle. This is shown in FIG. 4. Further angular translation of the cover in the second angular direction moves the flags on each blade from their position below the shelf in each slot and frees each blade so that it can be axially removed from each slot.

Once the connector 10 is removed from the receptacle, spring 98 pushes the shield 28 downwardly into its rest position shown in FIG. 1, and likewise, spring 78 pushes projection 57 and the cover 14 attached thereto to the left back to its rest position seen in FIG. 2. In this position, cam 61 is realigned with cam follower 134 as seen in FIG. 1, as are the other two cams and cam followers.

EMBODIMENT OF FIG. 11

As seen in FIG. 11, a slightly modified embodiment of the subject invention is shown comprising male electrical connector 10'. This modified connector is constructed in a fashion similar to that shown in FIGS. 1–10, except that the clamping assembly is outside the cover, and the cover itself does not have an end wall, but is merely an open-ended sleeve coupled to the plug body. Otherwise, connector 10' operates in a fashion substantially similar to connector 10. In FIG. 11, elements similar to those shown in FIGS. 1–10 are designated by the same reference numeral with the addition of a prime.

Thus, male electrical connector 10' comprises a cover 14', a plug body 16', a blade retainer 22', a shield 28' and three blades 24'–26'.

In this embodiment, the plug body 16' has a downwardly facing ring 160 near the top thereof spaced from the rest of the plug body via an annular groove 162. The top of the cover 14' has an upwardly and outwardly facing annular groove 164 slidably receiving ring 160 and has an upwardly extending ring 166 slidably received in groove 162 in the plug body. This allows for angular translation of the cover relative to the plug body. The cover has similar projections 54' extending into similar slots 74' in the plug body 16'.

The clamping assembly 20' comprises first and second clamping members 82' and 83' which are connected via tightening screws not shown around cable 12' as in the embodiment of FIGS. 1–10. Each of the clamping members is slidably coupled to the top of the plug body via an inverted T-shaped slot or mortise 168 in the top of the plug body, and an inverted T-shaped projection or tenon 170 extending downwardly from each clamping member.

Also shown in this embodiment is a slip washer 172 surrounding cable 12' in the plug body 16' as well as an elastomeric seal 174 surrounding the conductors extending from cable 12'.

While advantageous embodiments have been chosen to illustrate the invention, it will be understood by those skilled in the art that various changes and modifications can be made therein without departing from the scope of the invention as defined in the appended claims.

What is claimed is:

1. A male electrical connector, the combination comprising:

a tubular cover having a first open end adapted to receive an electrical cable, and a second open end;

an insulating plug body adapted to receive the electrical cable, and having a plurality of conductive blades extending therefrom, said blades being shaped and dimensioned for insertion into and translation in slots formed in a mating female connector as said plug body is moved axially and angularly, respectively, relative to the female connector;

first means, coupled to said cover and plug body, for coupling said plug body in said cover for limited relative angular movement;

a plate having a plurality of openings, each of said openings slidably receiving one of said blades therein;

second means, coupled to said plate and plug body, for slidably coupling said plate and plug body between first and second axially displaced positions;

locking means, coupled to and extending from said plate and receivable in at least one of the slots in the female connector once said blades are inserted into and translated in a first angular direction in the slots, for resisting relative angular translation of said plate and the female connector in a second angular direction opposite said first angular direction; and unlocking means, coupled to said cover and plate, for removing said locking means from said at least one of the slots, and thereby allowing relative angular translation of said plate and the female connector in said second angular direction, said unlocking means being actuated via angular movement of said cover relative to said plate and plug body in said second angular direction.

2. A male electrical connector according to claim 1, and further including biasing means, coupled to said plate and plug body, for biasing said plate away from said plug body into said first position spaced away from said plug body.

3. A male electrical connector according to claim 1, and further including a tubular wall extending from said plate and being slidably received in said cover through said second end.

4. A male electrical connector, the combination comprising:

a tubular cover having a first open end adapted to receive an electrical cable, and a second open end;

an insulating plug body adapted to receive the electrical cable, and having a plurality of conductive blades extending therefrom, said blades being shaped and dimensioned for insertion into and translation in slots formed in a mating female connector as said plug body is moved axially and angularly, respectively, relative to the female connector;

first means, coupled to said cover and plug body, for coupling said plug body in said cover for limited relative angular movement;

a shield comprising a plate and a tubular wall extending from said plate, said tubular wall being slidably received in said cover through said second end, said plate having a plurality of openings, each of said openings slidably receiving one of said blades therein;

second means, coupled to said shield and plug body, for slidably coupling said shield and plug body between first and second axially displaced positions;

biasing means, coupled to said shield and plug body, for biasing said plate away from said plug body into said first position spaced away from said plug body;

locking means, coupled to and extending from said plate and receivable in at least one of the slots in the female connector once said blades are inserted into and translated in a first angular direction in the slots, for resisting relative angular translation of said plate and the female connector in a second angular direction opposite said first angular direction; and unlocking means, coupled to said cover and shield, for removing said locking means from said at least one of the slots, and thereby allowing relative angular translation of said plate and the female connector in said second angular direction, said unlocking means being actuated via angular movement of said cover relative to said shield and plug body in said second angular direction.

5. A male electrical connector according to claim 4, wherein said locking means comprises a plurality of prongs rigidly coupled to said plate.

6. A male electrical connector according to claim 5, wherein each of said prongs has a planar leading and trailing edge, both of said edges being substantially parallel to the longitudinal axis of said plug body.

7. A male electrical connector according to claim 4, wherein said unlocking means comprises at least one cam coupled to said cover and at least one cam follower coupled to said shield.

8. A male electrical connector according to claim 7, wherein said cam has a first surface facing towards said plate and a second surface facing towards said second angular direction.

9. A male electrical connector according to claim 8, wherein said second surface tapers.

10. A male electrical connector according to claim 7, wherein said cam is substantially triangular in elevation.

11. A male electrical connector according to claim 7, wherein said cam follower has a first surface facing away from said plate and a second surface facing towards said first angular direction.

12. A male electrical connector according to claim 11, wherein said second surface tapers.

13. A male electrical connector according to claim 10, wherein said cam follower is substantially a right trapezoid in elevation.

14. A male electrical connector according to claim 7, wherein said cam follower is substantially a right trapezoid in elevation.

15. A male electrical connector according to claim 7, wherein said cam follower has a third surface facing towards said second angular direction.

16. A male electrical connector according to claim 15, wherein said cam has a third surface facing towards said first angular direction.

17. A male electrical connector according to claim 7, wherein said cam follower has a surface facing said first angular direction having an axial extent at least equal to the axial length of said locking means.

18. A male electrical connector according to claim 4, wherein said plug body has cable clamping means thereon, said cable clamping means being received in said cover.

19. A male electrical connector according to claim 4, wherein said plug body has cable clamping means thereon, said cable clamping means being located outside said cover.

20. A male electrical connector according to claim 4, wherein said first means comprises a plurality of slots located in said plug body, and a plurality of projections located on said cover, one of said projections being slidably received in each of said slots.

21. A male electrical connector according to claim 4, wherein said first means includes a spring located in one of said slots and normally biasing the projection located in said one of said slots in said first angular direction.

22. A male electrical connector according to claim 4, wherein said first means includes means for biasing said cover in said first angular direction relative to said shield and plug body.

23. A male electrical connector according to claim 4, wherein said second means comprises a plurality of projections extending from said plug body and a plurality of slots in said shield, one of said projections being received in each of said slots.

24. A male electrical connector according to claim 4, and further including cable clamping means integrally coupled to said plug body.

* * * * *